US006615626B2

(12) United States Patent
Yu et al.

(10) Patent No.: US 6,615,626 B2
(45) Date of Patent: Sep. 9, 2003

(54) LOCK DEVICE HAVING ROTATABLE IDENTIFICATION BRAND

(76) Inventors: Chun Te Yu, 41-21, Guan Tso Street, Fu Shing, Changhwa (TW), 506; Ming Chang Shih, No. 3, Lane 438, Minsheng Rd., Changhwa City (TW), 500

( * ) Notice: Subject to any disclaimer, the term of this patent is extended or adjusted under 35 U.S.C. 154(b) by 0 days.

(21) Appl. No.: 09/978,075

(22) Filed: Oct. 17, 2001

(65) Prior Publication Data

US 2003/0070459 A1 Apr. 17, 2003

(51) Int. Cl.[7] ..... E05B 37/00

(52) U.S. Cl. ..... 70/301; 70/25; 70/312; 70/460; 40/330; 40/111; 283/74

(58) Field of Search ..... 70/22, 24, 25, 70/30, 301, 304–306, 312, 442–445, 460; 40/111, 112, 114, 299, 330, 6, 625, 626, 633; 283/74, 75, 80, 81

(56) References Cited

U.S. PATENT DOCUMENTS 188,522 A * 3/1877 Livermore ..... 40/6
462,667 A * 11/1891 Goldbeck ..... 40/6
717,867 A * 1/1903 King ..... 70/25
1,339,446 A * 5/1920 Fidrocki ..... 70/25
1,367,233 A * 2/1921 Brockup ..... 70/25
1,429,091 A * 9/1922 Oppman ..... 40/626
1,834,091 A * 12/1931 Cruse ..... 70/312 X
1,841,266 A * 1/1932 Jones ..... 40/330
1,915,563 A * 6/1933 Wainwright, Jr. ..... 40/330
2,537,598 A * 1/1951 Mason ..... 40/330 X
2,931,657 A * 4/1960 Lewis ..... 273/155
2,976,630 A * 3/1961 Montfort ..... 40/503 X
3,251,150 A * 5/1966 Sedgwick et al. ..... 283/74 X
3,584,598 A * 6/1971 Gayle ..... 40/111 X
3,829,994 A * 8/1974 Dillon ..... 40/634
3,930,326 A * 1/1976 Rosa ..... 40/114
4,224,894 A * 9/1980 Haldemann ..... 40/495 X
4,408,406 A * 10/1983 Barton ..... 40/19
5,143,466 A * 9/1992 Moncrieff Baldwin et al. ..... 283/81 X
5,400,625 A * 3/1995 Embry ..... 70/460 X
5,782,024 A * 7/1998 Pausch ..... 40/330
6,164,096 A * 12/2000 Lai ..... 70/25
6,227,016 B1 * 5/2001 Yu ..... 70/30
6,408,660 B1 * 6/2002 Lai ..... 70/30
6,409,057 B1 * 6/2002 Kim ..... 40/322 X

* cited by examiner

*Primary Examiner*—Suzanne Dino Barrett
(74) *Attorney, Agent, or Firm*—Rosenberg, Klein & Lee

(57) ABSTRACT

A lock device having a rotatable identification brand includes a lock body defining a receiving space and formed with at least one view window, a rotatable member rotatably mounted in the receiving space of the lock body and provided with identification information that may be seen through the view window of the lock body, and a drive mechanism mounted on the rotatable member for rotating the rotatable member. The rotatable member may be driven and rotated by the drive mechanism, so that the user may watch the information printed on the rotatable member through the view window, thereby facilitating other people identifying the owner of the lock device, and thereby enhancing the aesthetic quality of the lock device.

11 Claims, 8 Drawing Sheets

LOCK DEVICE HAVING ROTATABLE IDENTIFICATION BRAND

BACKGROUND OF THE INVENTION

1. Field of the Invention

The present invention relates to a lock device having a rotatable identification brand, and more particularly to a lock device having a rotatable identification brand, that may facilitate other people identifying the owner of the lock device, and may enhance the aesthetic quality of the lock device.

2. Description of the Related Art

The closest prior art of which the applicant is aware is disclosed in the applicant's Taiwanese Patent Publication No. 444798, entitled by "Lock Device Having a Scrollable Writing Brand". In the said patent, the lock device having an identification brand may be used on the article such as a luggage, a suitcase or the like, thereby facilitating other people identifying the owner of the article.

SUMMARY OF THE INVENTION

The primary objective of the present invention is to provide a lock device having a rotatable identification brand, wherein the rotatable member may be driven and rotated by the drive mechanism, so that the user may watch the information printed on the rotatable member through the view window, thereby facilitating other people identifying the owner of the lock device, and thereby enhancing the aesthetic quality of the lock device.

In accordance with the present invention, there is provided a lock device having a rotatable identification brand, comprising:

- a lock body, defining a receiving space and formed with at least one view window;
- a rotatable member, rotatably mounted in the receiving space of the lock body, and provided with identification information that may be seen through the view window of the lock body; and
- a drive mechanism, mounted on the rotatable member for rotating the rotatable member.

Further benefits and advantages of the present invention will become apparent after a careful reading of the detailed description with appropriate reference to the accompanying drawings.

DETAILED DESCRIPTION OF THE INVENTION

Figure 1:
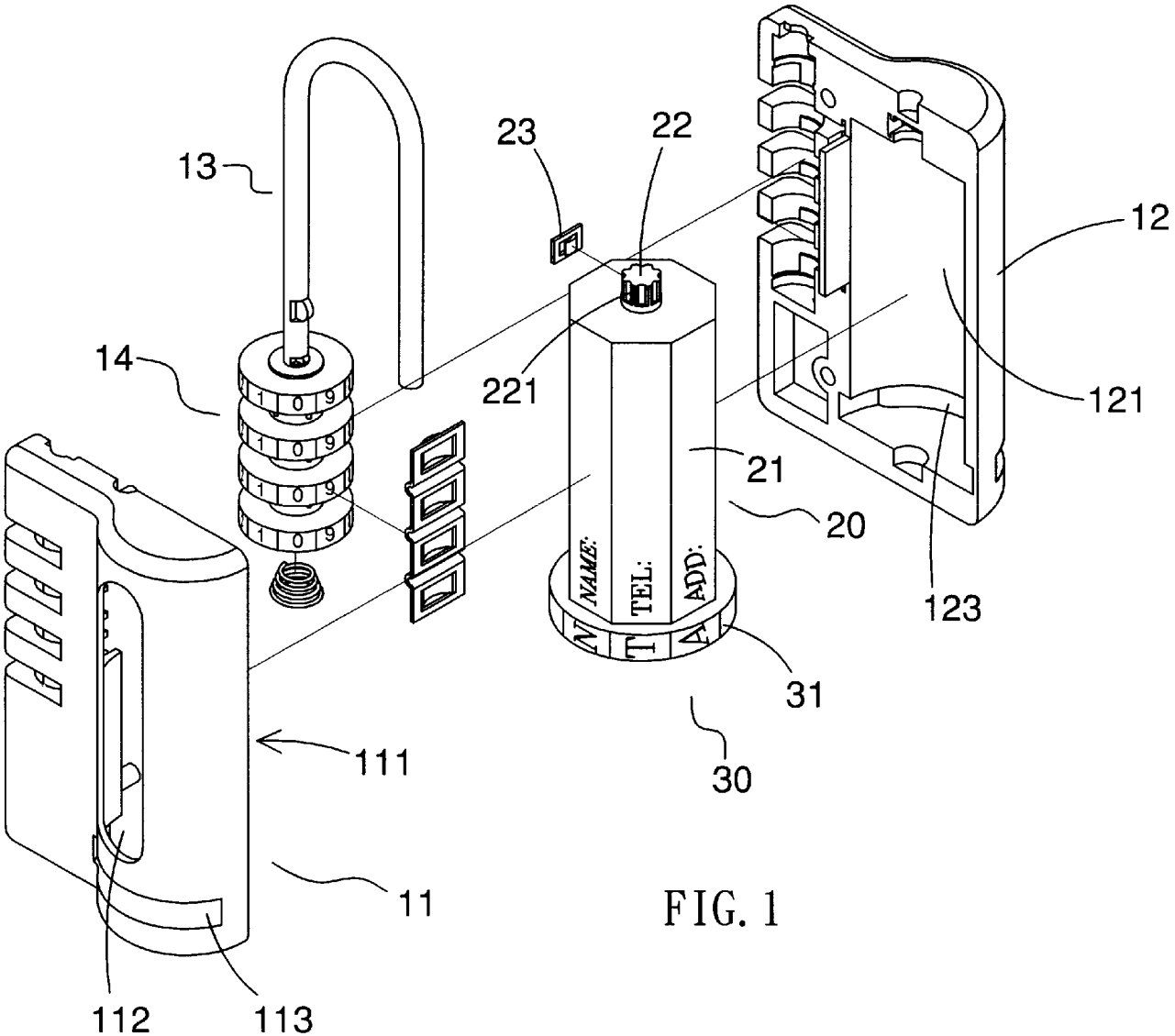
FIG. 1 is an exploded perspective view of a lock device having a rotatable identification brand in accordance with a first embodiment of the present invention.
Figure 2:
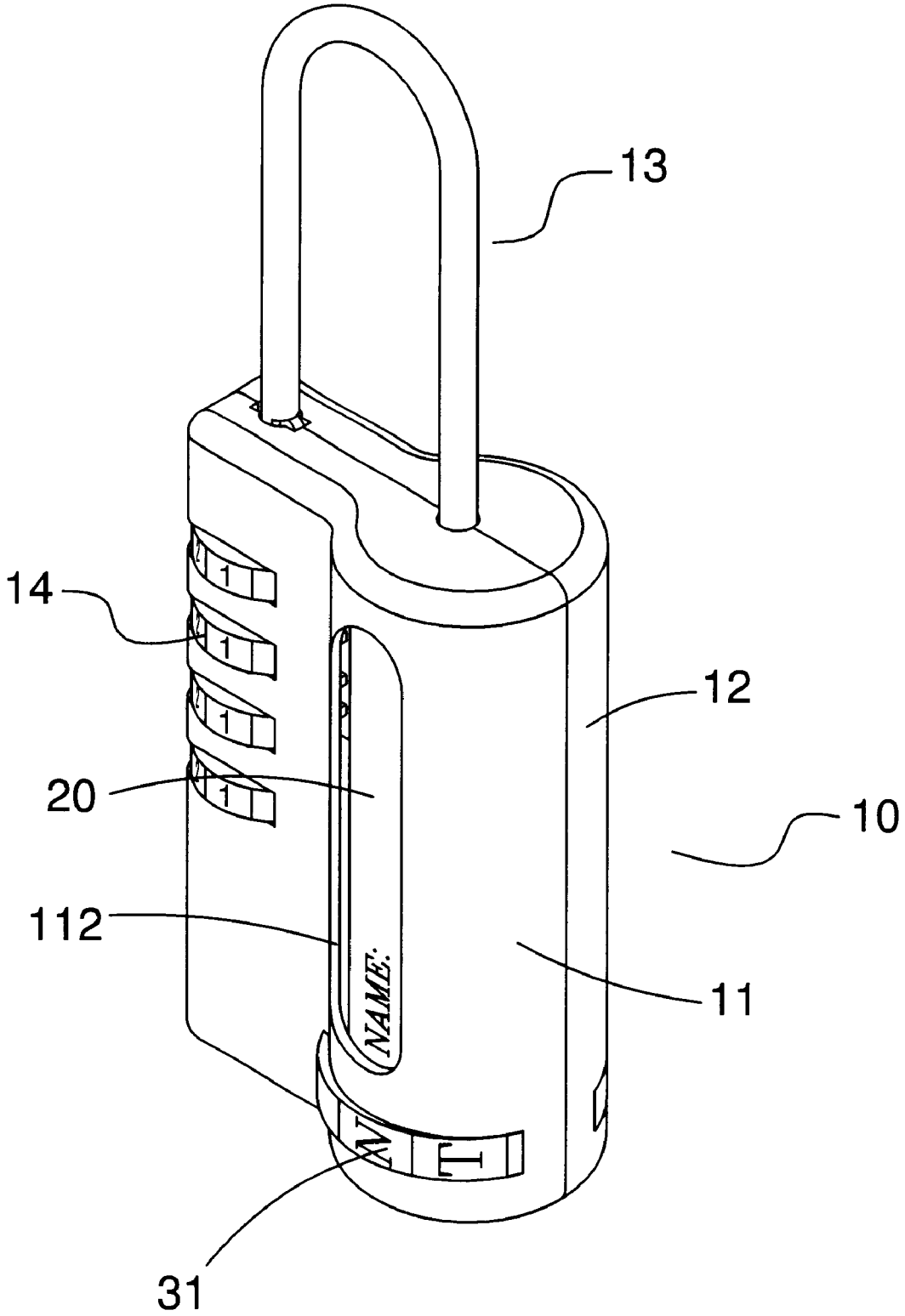
FIG. 2 is a perspective assembly view of the lock device having a rotatable identification brand as shown in FIG. 1.

Referring to the drawings and initially to FIGS. 1 and 2, a lock device having a rotatable identification brand in accordance with a first embodiment of the present invention comprises a lock body 10, a rotatable member 20, and a drive mechanism 30.

The lock body 10 includes a first casing 11, and a second casing 12 coupled with each other. A number wheel assembly 14 is mounted in the lock body 10, and a lock hook 13 is mounted on the lock body 10 and is pivoted on the number wheel assembly 14.

The first casing 11 is formed with a semi-circular first receiving chamber 111, and the second casing 12 is formed with a semi-circular second receiving chamber 121, so that when the first casing 11 and the second casing 12 are coupled with each other, the first receiving chamber 111 and the second receiving chamber 121 may form a receiving space for receiving the rotatable member 20.

The rotatable member 20 with a polygonal configuration is rotatably mounted in the receiving space formed by the first receiving chamber 111 of the first casing 11 and the second receiving chamber 121 of the second casing 12 of the lock body 10. Preferably, the rotatable member 20 is an octagonal elongated body that is formed with eight writing faces 21 each of which may be written or printed with information such as the name, telephone number, address or the like. A positioning wheel 22 is formed or secured on a first end of the rotatable member 20 to rotate therewith, and has multiple arcuate teeth 221. An elastic plate 23 is secured in the lock body 10, and is engaged with or pressed on the arcuate teeth 221 of the positioning wheel 22 elastically, thereby providing a better positioning effect during rotation of the rotatable member 20.

The drive mechanism 30 is mounted on a second end of the rotatable member 20. Preferably, the drive mechanism 30 is integrally formed on the second end of the rotatable member 20, and includes an enlarged rotation disk 31 having a larger outer diameter. The rotation disk 31 is partially protruded outward from the lock body 10 for facilitating the user driving and rotating the rotation disk 31.

The first casing 11 is formed with a view window 112 for exposing the writing face 21 of the rotatable member 20. The first casing 11 is formed with a first arcuate slot 113, and the second casing 12 is formed with a second arcuate slot 123, for exposing the rotation disk 31 of the drive mechanism 30, thereby facilitating the user driving and rotating the rotation disk 31.

Figure 3:
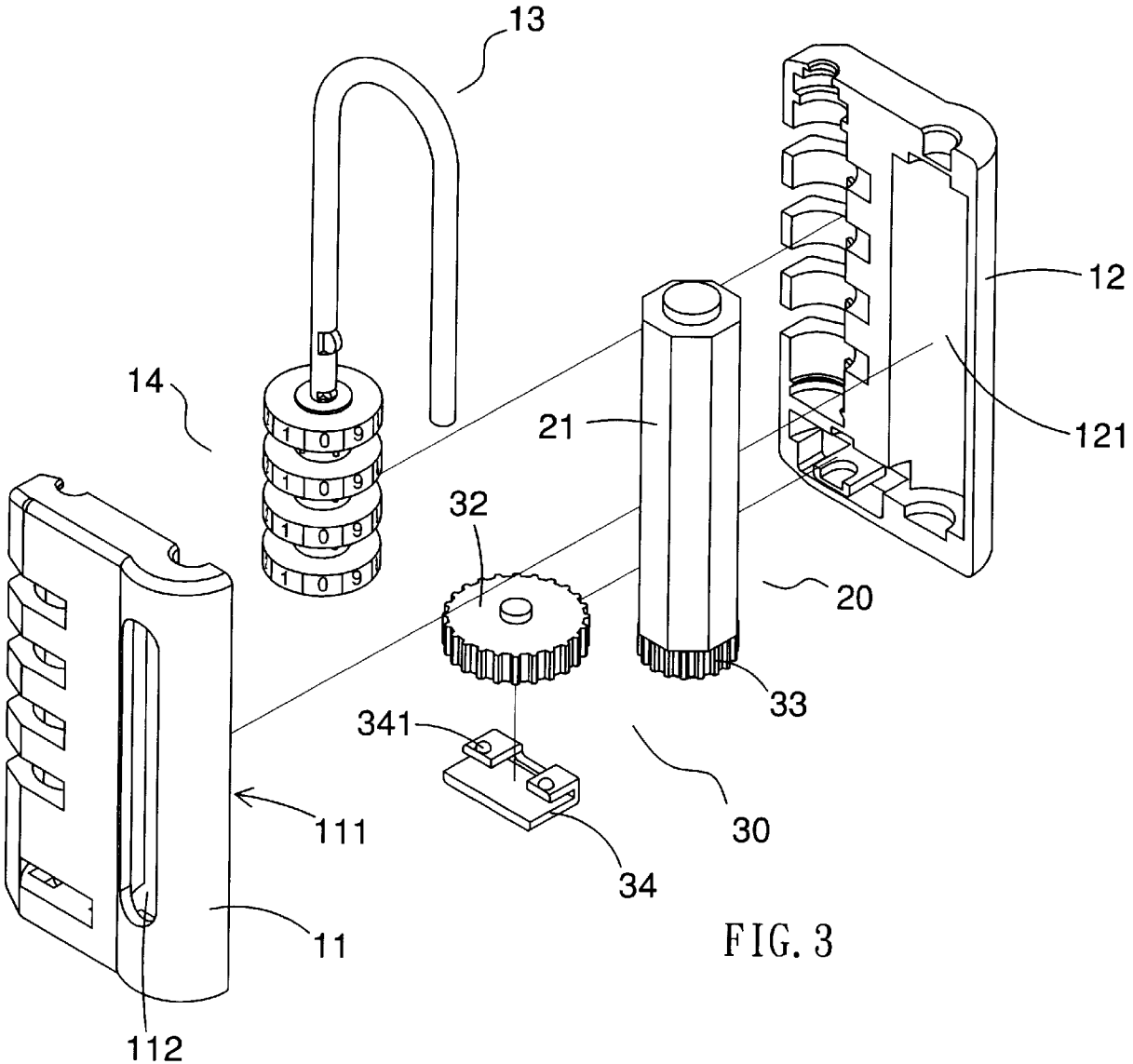
FIG. 3 is an exploded perspective view of a lock device having a rotatable identification brand in accordance with a second embodiment of the present invention.
Figure 4:
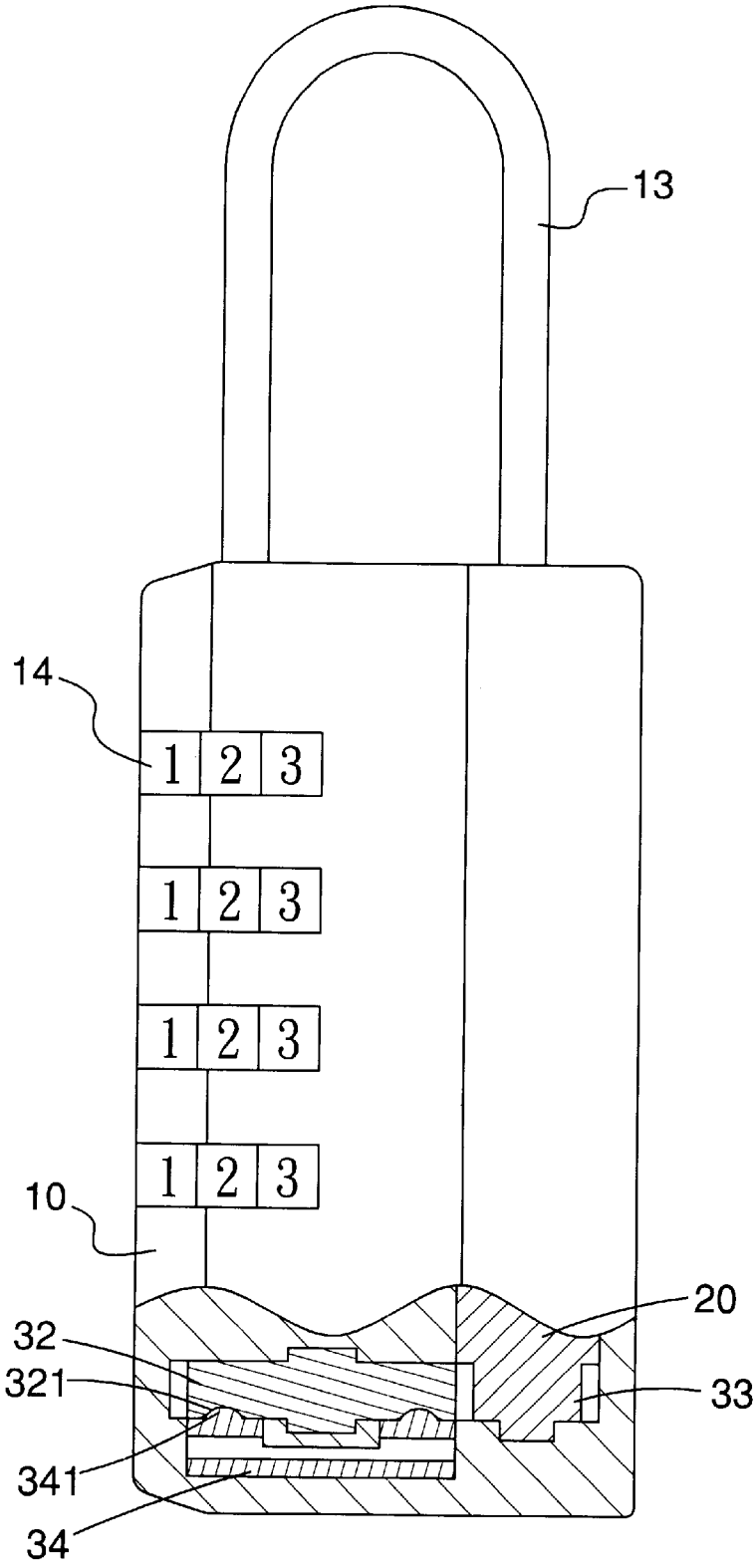
FIG. 4 is a side plan cross-sectional assembly view of the lock device having a rotatable identification brand as shown in FIG. 3.

Referring to FIGS. 3 and 4, in accordance with a second embodiment of the present invention, the drive mechanism 30 includes a drive gear 32, and a driven gear 33.

The driven gear 33 is integrally formed on the second end of the rotatable member 20. The drive gear 32 is rotatably mounted in the lock body 10, and meshes with the driven gear 33 for driving and rotating the driven gear 33. The drive gear 32 is partially protruded outward from the first casing 11 and the second casing 12 of the lock body 10 for facilitating the user driving and rotating the drive gear 32 so as to rotate the rotatable member 20. The drive gear 32 has a bottom formed with multiple recesses 321. An elastic plate 34 is secured in the lock body 10, and is provided with at least one boss 341 that may be inserted into one of the recesses 321 of the drive gear 32 elastically, thereby providing a better positioning effect during rotation of the rotatable member 20.

Figure 5:
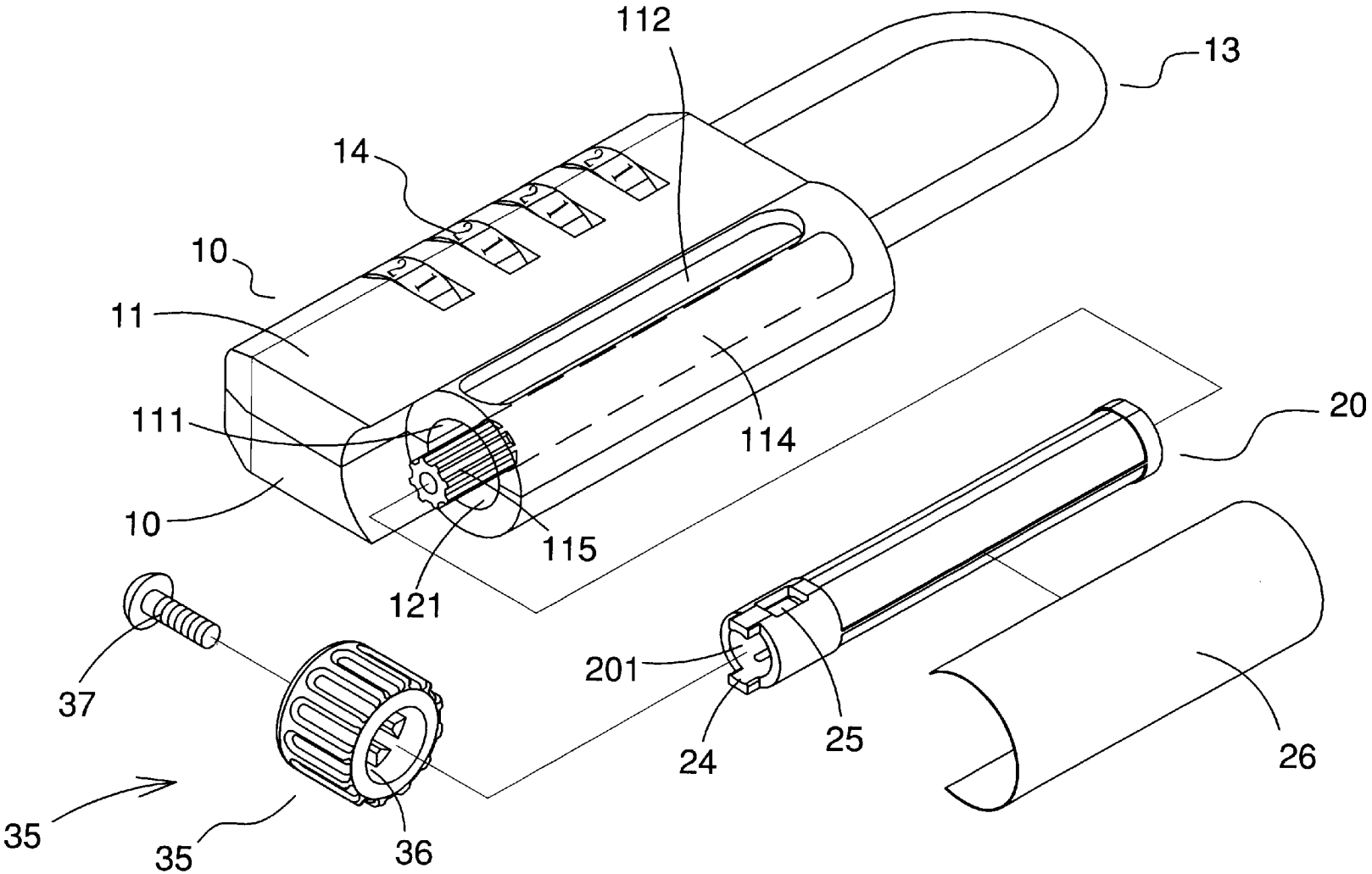
FIG. 5 is an exploded perspective view of a lock device having a rotatable identification brand in accordance with a third embodiment of the present invention.
Figure 6:
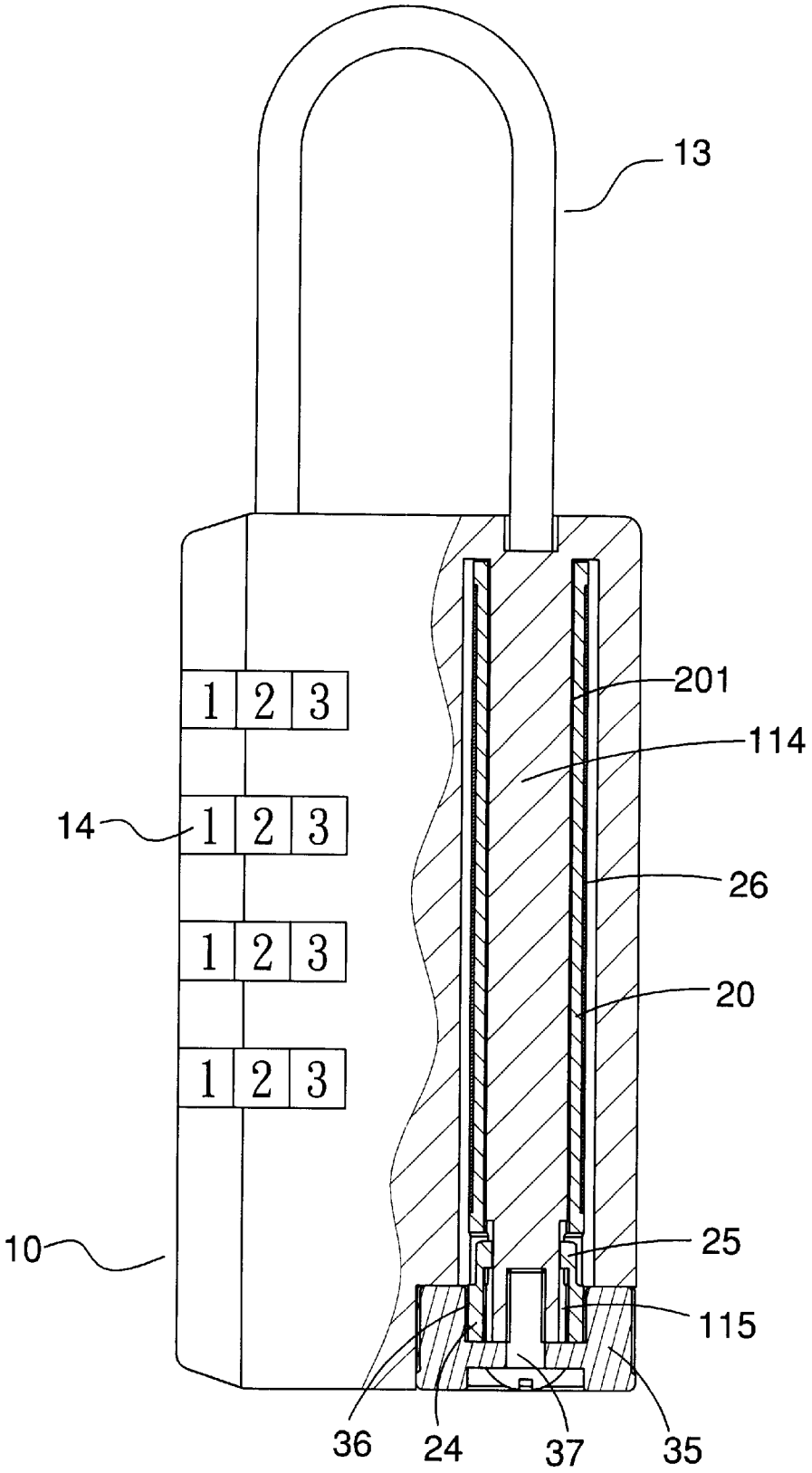
FIG. 6 is a side plan cross-sectional assembly view of the lock device having a rotatable identification brand as shown in FIG. 5.
Figure 7:
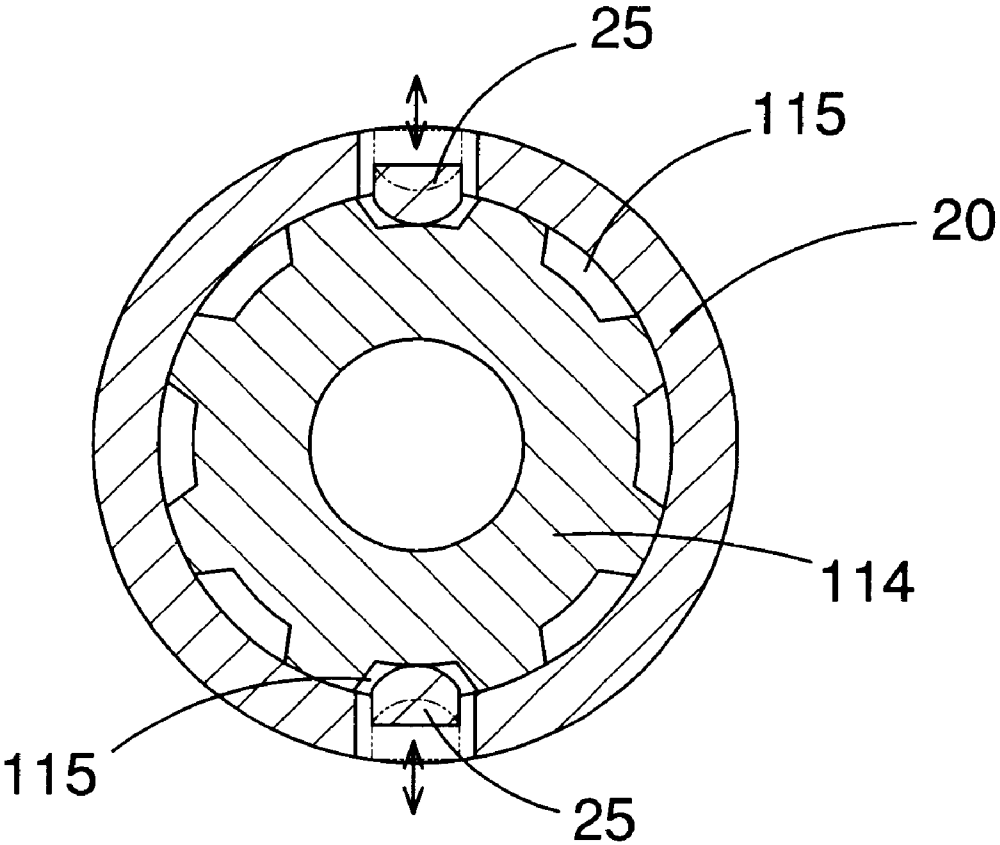
FIG. 7 is a bottom plan cross-sectional assembly view of the lock device having a rotatable identification brand as shown in FIG. 5.

Referring to FIGS. 5–7, in accordance with a third embodiment of the present invention, the lock body 10 includes a pivot column 114 which is integrally formed on and protruded from the end face of the first receiving chamber 111 of the first casing 11 or the end face of the second receiving chamber 121 of the second casing 12. The pivot column 114 has a distal end formed with multiple tooth grooves 115.

The cylindrical rotatable member 20 is mounted on the pivot column 114, and is formed with a circular hole 201 for receiving the pivot column 114. The rotatable member 20 has a distal end formed with multiple elastic snaps 25 that may be snapped into the tooth grooves 115 of the pivot column 114 elastically, thereby providing a better positioning effect during rotation of the rotatable member 20. The distal end of the rotatable member 20 is also provided with multiple plugs 24.

The drive mechanism 30 includes a rotation knob 35 that is secured on the distal end of the rotatable member 20 for driving and rotating the rotatable member 20, and is formed with multiple insertion grooves 36 for securing the multiple plugs 24 of the rotatable member 20, so that the rotatable member 20 may be driven and rotated by the rotation knob 35 of the drive mechanism 30. A screw 37 is extended through the rotation knob 35, and is screwed into the distal end of the pivot column 114, for pivoting the rotation knob 35 on the distal end of the pivot column 114. A bonding paper 26 is bonded on the surface of the rotatable member 20, and may be written or printed with information such as the name, telephone number, address or the like. Thus, the rotatable member 20 may be driven and rotated by the rotation knob 35 of the drive mechanism 30, so that the user may watch the information printed on the bonding paper 26 through the view window 112.

Figure 8:
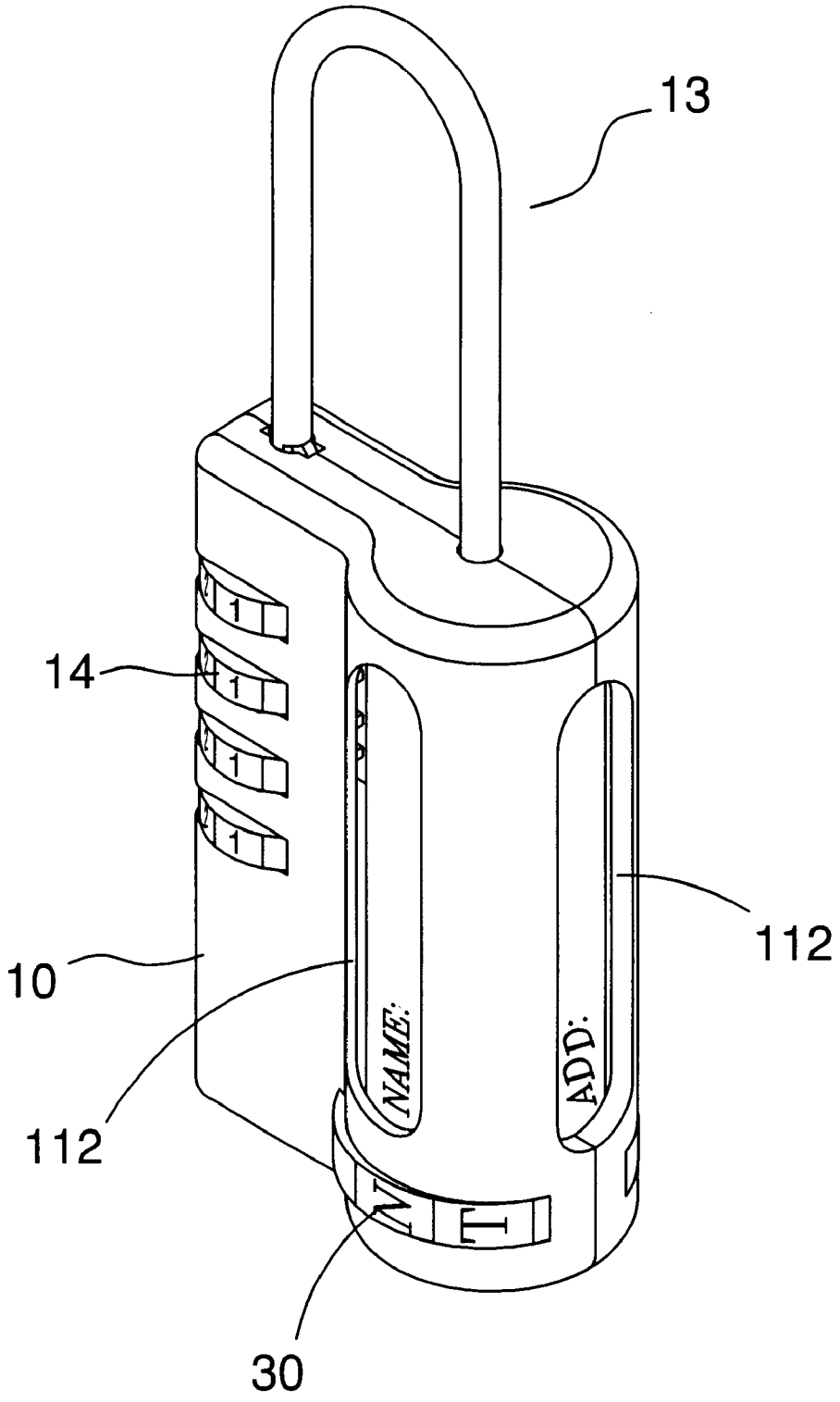
FIG. 8 is a perspective view of a lock device having a rotatable identification brand in accordance with a fourth embodiment of the present invention.

Referring to FIG. 8, in accordance with a fourth embodiment of the present invention, the lock body 10 is formed with multiple view windows 112.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lock device having a rotatable identification brand, comprising:

a lock body, defining a receiving space and formed with at least one view window;

a rotatable member, rotatably mounted in the receiving space of the lock body, and provided with identification information that may be seen through the view window of the lock body; and a drive mechanism, mounted on the rotatable member for rotating the rotatable member, wherein:

the drive mechanism includes a driven gear integrally formed on one end of the rotatable member, and a drive gear rotatably mounted in the lock body and meshing with the driven gear for driving and rotating the driven gear.

2. The lock device having a rotatable identification brand in accordance with claim 1, wherein the drive gear has a bottom formed with multiple recesses, and an elastic plate is secured in the lock body, and is provided with at least one boss that may be inserted into one of the recesses of the drive gear elastically, thereby providing a better positioning effect during rotation of the rotatable member.

3. The lock device having a rotatable identification brand in accordance with claim 1, wherein the lock body includes a pivot column mounted in the receiving space of the lock body, and the rotatable member is rotatably mounted on the pivot column, and is formed with a circular hole for receiving the pivot column.

4. The lock device having a rotatable identification brand in accordance with claim 3, wherein the pivot column has a distal end formed with multiple tooth grooves, and the rotatable member has a distal end formed with multiple elastic snaps that may be snapped into the tooth grooves of the pivot column elastically, thereby providing a better positioning effect during rotation of the rotatable member.

5. The lock device having a rotatable identification brand in accordance with claim 4, wherein the distal end of the rotatable member is provided with multiple plugs, and the drive mechanism includes a rotation knob secured on the distal end of the rotatable member for rotating the rotatable member, and formed with multiple insertion grooves for securing the multiple plugs of the rotatable member, so that the rotatable member may be driven and rotated by the rotation knob of the drive mechanism.

6. The lock device having a rotatable identification brand in accordance with claim 5, further comprising a screw extended through the rotation knob, and screwed into the distal end of the pivot column for pivoting the rotation knob on the distal end of the pivot column.

7. The lock device having a rotatable identification brand in accordance with claim 1, further comprising a bonding paper bonded on the surface of the rotatable member and printed with information thereon.

8. The lock device having a rotatable identification brand in accordance with claim 1, wherein the rotatable member is a polygonal elongated body.

9. The lock device having a rotatable identification brand in accordance with claim 1, wherein the rotatable member is a octagonal elongated body.

10. The lock device having a rotatable identification brand in accordance with claim 1, wherein the rotatable member is a cylindrical body.

11. The lock device having a rotatable identification brand in accordance with claim 1, wherein the rotatable member is provided with multiple writing faces.

* * * * *